US012178292B2

(12) United States Patent
Maselino

(10) Patent No.: US 12,178,292 B2
(45) **Date of Patent: *Dec. 31, 2024**

(54) STRAP SYSTEM FOR ARTICLE OF FOOTWEAR

(71) Applicant: Nike, Inc., Beaverton, OR (US)

(72) Inventor: Gabriel T. Maselino, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/178,316

(22) Filed: Mar. 3, 2023

(65) Prior Publication Data

US 2023/0200494 A1 Jun. 29, 2023

Related U.S. Application Data

(63) Continuation of application No. 16/881,551, filed on May 22, 2020, now Pat. No. 11,617,420.

(51) Int. Cl.

| | |
|---|---|
| ***A43C 11/20*** | (2006.01) |
| ***A43B 23/02*** | (2006.01) |
| ***A43C 11/14*** | (2006.01) |

(52) U.S. Cl.

CPC ..... *A43C 11/20* (2013.01); *A43B 23/0245* (2013.01); *A43C 11/1493* (2013.01)

(58) Field of Classification Search

CPC ..... A43C 11/14; A43C 11/20; A43C 11/1493

See application file for complete search history.

(56) References Cited

U.S. PATENT DOCUMENTS

| | | | |
|---|---|---|---|
| 3,769,722 | A | 11/1973 | Rhee |
| D365,438 | S | 12/1995 | Orzeck |
| 5,557,866 | A | 9/1996 | Prengler |
| 5,659,982 | A | 8/1997 | Muraoka et al. |
| 5,794,360 | A | 8/1998 | Bell et al. |

(Continued)

FOREIGN PATENT DOCUMENTS

| | | | |
|---|---|---|---|
| CN | 103429109 | A | 12/2013 |
| CN | 108433244 | A | 8/2018 |

(Continued)

OTHER PUBLICATIONS

Extended European Search Report in EP Application No. 23175114.0, dated Aug. 17, 2023 (9 pages).

(Continued)

*Primary Examiner* — Megan E Lynch

(74) *Attorney, Agent, or Firm* — Bookoff McAndrews, PLLC

(57) ABSTRACT

An article of footwear includes an upper defining a throat configured to receive a foot. The article of footwear also includes a sole structure coupled to the upper. The article of footwear further includes a panel having a first side coupled to the upper for movement between an open position and a closed position. The panel exposes a portion of the throat in the open position and covers the portion of the throat in the closed position. The article of footwear also includes a strap having a first end and a second end opposite the first end. The first end and the second end are disposed on a first side of the upper with a body portion of the strap disposed between the first end and the second end surrounding the upper.

19 Claims, 8 Drawing Sheets

(56) References Cited

U.S. PATENT DOCUMENTS

| | | | | |
|---|---|---|---|---|
| 5,819,439 | A * | 10/1998 | Sanchez | A43B 7/1495 36/89 |
| 6,324,773 | B1 * | 12/2001 | Gaither | A43C 11/14 36/50.1 |
| D473,702 | S * | 4/2003 | Burg | D2/969 |
| 6,637,130 | B2 * | 10/2003 | Urie | A43B 3/126 36/11.5 |
| 6,694,641 | B1 | 2/2004 | Gill | |
| 6,772,541 | B1 * | 8/2004 | Ritter | A43C 11/14 36/91 |
| 7,487,603 | B2 | 2/2009 | Davis et al. | |
| 7,654,012 | B2 * | 2/2010 | Kelley | A43C 11/1493 36/138 |
| 8,850,721 | B2 | 10/2014 | Long et al. | |
| 9,462,851 | B2 * | 10/2016 | Baker | A43B 23/00 |
| 9,596,904 | B2 * | 3/2017 | Bishop | A43B 23/07 |
| D798,583 | S | 10/2017 | Enayah | |
| D813,522 | S | 3/2018 | Cin | |
| D857,370 | S * | 8/2019 | Petrie | D2/973 |
| D858,080 | S * | 9/2019 | Petrie | D2/973 |
| 2002/0163146 | A1 | 11/2002 | Paul | |
| 2004/0181972 | A1 * | 9/2004 | Csorba | A43B 23/0265 36/50.1 |
| 2005/0115109 | A1 * | 6/2005 | Goldman | A43B 7/1464 36/50.5 |
| 2007/0277398 | A1 * | 12/2007 | Davis | A43B 1/0081 36/50.1 |
| 2009/0071041 | A1 * | 3/2009 | Hooper | A43B 23/0245 36/25 R |
| 2009/0217552 | A1 * | 9/2009 | Paintin | A43B 11/00 36/138 |
| 2009/0272007 | A1 * | 11/2009 | Beers | A43C 11/00 36/50.1 |
| 2011/0258876 | A1 * | 10/2011 | Baker | A43C 11/1493 36/50.1 |
| 2011/0308108 | A1 | 12/2011 | Berns et al. | |
| 2012/0005923 | A1 * | 1/2012 | Beers | A43B 3/34 36/50.1 |
| 2015/0257489 | A1 * | 9/2015 | Trudel | A43B 5/003 12/142 LC |
| 2016/0270484 | A1 * | 9/2016 | Zadnik | A43C 1/06 |
| 2016/0302515 | A1 * | 10/2016 | Xanthos | A43B 13/14 |
| 2016/0309844 | A1 * | 10/2016 | Smith | A43B 3/126 |
| 2016/0324257 | A1 * | 11/2016 | Ko | A43B 13/145 |
| 2017/0273814 | A1 * | 9/2017 | Berns | A43C 11/14 |
| 2018/0242692 | A1 * | 8/2018 | Houng | A43C 11/1493 |
| 2019/0313742 | A1 | 10/2019 | Bell et al. | |
| 2019/0335847 | A1 | 11/2019 | Soderqvist | |
| 2019/0365017 | A1 * | 12/2019 | Sandy | A43C 1/00 |
| 2019/0365022 | A1 | 12/2019 | Linkfield et al. | |
| 2020/0138147 | A1 * | 5/2020 | Fogg | A43C 1/00 |
| 2020/0205515 | A1 * | 7/2020 | Cross | A43C 1/06 |
| 2021/0022449 | A1 | 1/2021 | Hatfield et al. | |

FOREIGN PATENT DOCUMENTS

| | | | |
|---|---|---|---|
| CN | 110958843 | A | 4/2020 |
| FR | 2615074 | A1 | 11/1988 |
| KR | 101770503 | B1 | 8/2017 |
| WO | 9215214 | A1 | 9/1992 |

OTHER PUBLICATIONS

European Patent Office, PCT International Search Report/Written Opinion for Application PCT/US2021/033597 dated Aug. 9, 2021.
Chinese Office Action, CN App. No. 2021800108442, mailed May 21, 2024. (7 pages).

* cited by examiner 200
206
209, 209-1
209, 209-2
318, 318-1
320, 320-1
304, 304-1
320, 320-1
202
304, 304-2
318, 318-2
304, 304-1
320, 320-2
320, 320-2
304, 304-2
210
210
208
204

FIG. 6
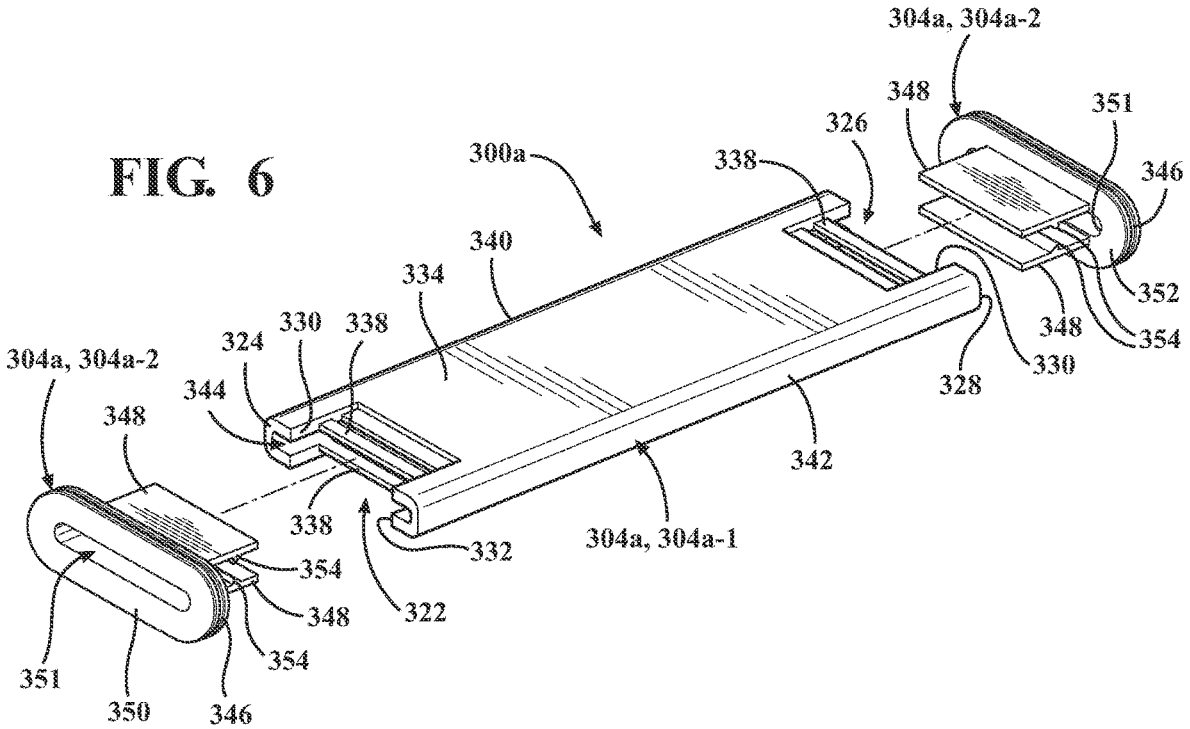
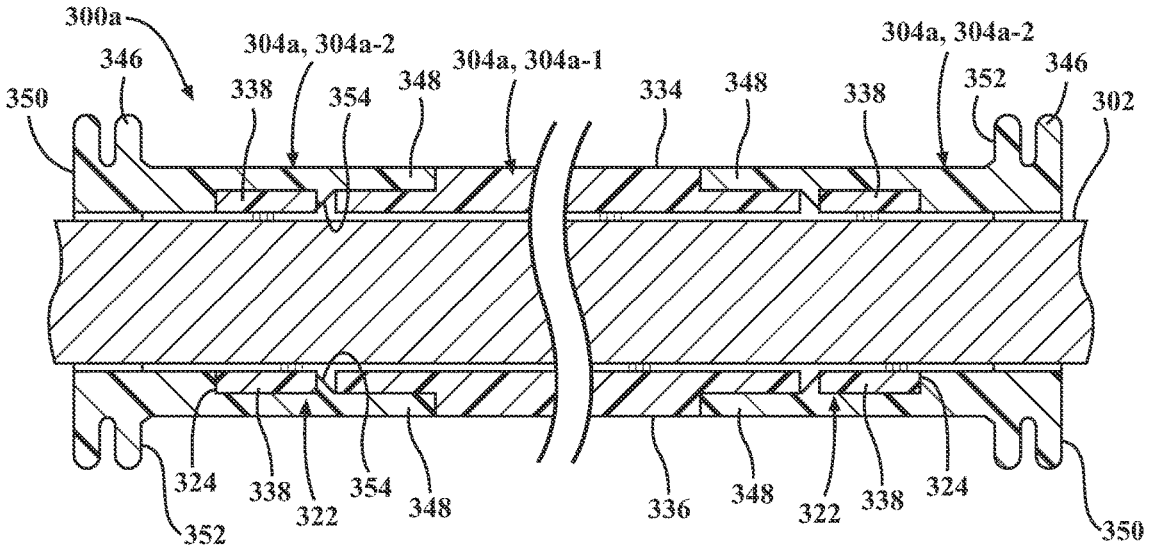
FIG. 7

STRAP SYSTEM FOR ARTICLE OF FOOTWEAR

CROSS-REFERENCE TO RELATED APPLICATION

This application is a continuation of U.S. application Ser. No. 16/881,551, filed May 22, 2020, the entirety of which is herein incorporated by reference.

FIELD

The present disclosure relates generally to articles of footwear having a strap system for moving the footwear between a tightened state and a loosened state.

BACKGROUND

This section provides background information related to the present disclosure and is not necessarily prior art.

Articles of footwear conventionally include an upper and a sole structure. The upper may be formed from any suitable material(s) to receive, secure, and support a foot on the sole structure. A bottom portion of the upper, proximate to a bottom surface of the foot, attaches to the sole structure. Sole structures generally include a layered arrangement extending between an outsole providing abrasion-resistance and traction with a ground surface and a midsole disposed between the outsole and the upper for providing cushioning for the foot.

The upper may cooperate with laces, straps, or other fastening systems to adjust the fit of the upper around the foot. For instance, laces may be tightened to close the upper around the foot and tied once a desired fit of the upper around the foot is attained. Care is required to ensure that the upper is not too loose or too tight around the foot each time the laces are tied.

While known fastening systems adequately secure an upper of an article of footwear to a foot of a wearer, such systems require use of two hands to properly tension and tie laces of the fastening system. As such, conventional systems are not easily used by persons having use of only one arm or hand.

DRAWINGS

The drawings described herein are for illustrative purposes only of selected configurations and are not intended to limit the scope of the present disclosure.

FIG. 6 is an exploded perspective view of routing elements for use with the article of footwear of FIG. 1A in accordance with principles of the present disclosure; and FIG. 7 is a cross-sectional view of the routing elements of FIG. 6.

Corresponding reference numerals indicate corresponding parts throughout the drawings.

DETAILED DESCRIPTION

Figure 1A:
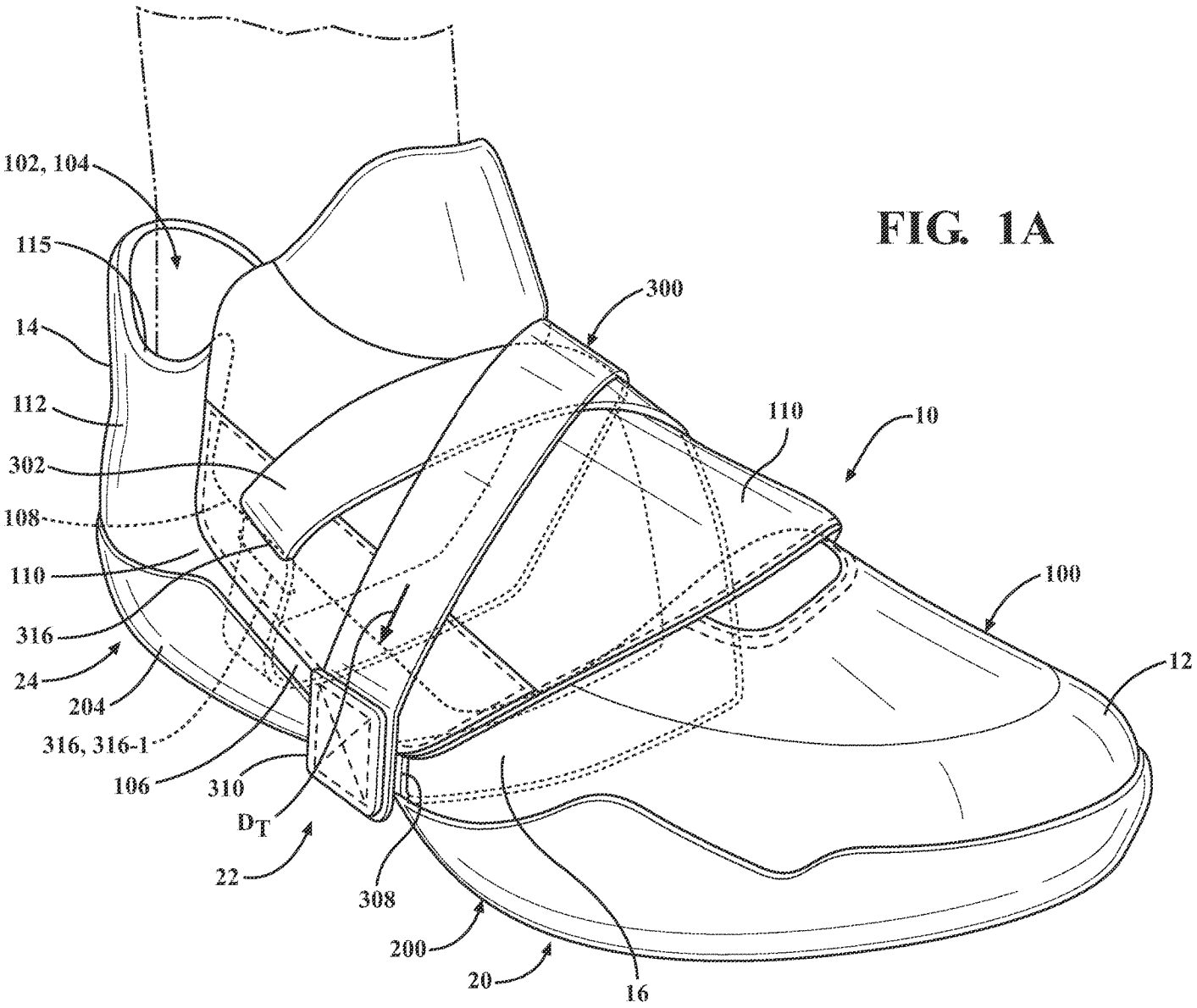
FIG. 1A is a lateral side perspective view of an article of footwear including a strap system in accordance with principles of the present disclosure, where the strap system is shown in a tightened state.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an article of footwear. The article of footwear includes an upper defining a throat configured to receive a foot and a sole structure coupled to the upper. The article of footwear also includes a panel having a first side coupled to the upper for movement between an open position and a closed position. The panel exposes a portion of the throat in the open position and covers the portion of the throat in the closed position. The article of footwear further includes a strap having a first end and a second end opposite the first end. The first end and the second end are disposed on a first side of the upper with a body portion of the strap disposed between the first end and the second end surrounding the upper.

Implementations of the disclosure may include one or more of the following optional features. In some implementations, the body portion of the strap includes a first portion and a second portion extending from the first portion, the first portion extending from the first end, the second portion extending from the second end and overlapping the first portion of the strap at an intersection. Here, the intersection may be disposed on the panel. The upper may include a lateral side and a medial side, the first portion of the strap and the second portion of the strap at least partially disposed along the lateral side and the medial side. At least a portion of the first portion of the strap may be disposed between the sole structure and the upper. Optionally, at least a portion of the second portion of the strap may be disposed between the sole structure and the upper.

In some examples, the sole structure defines a channel extending therethrough, the strap at least partially disposed within the channel. The article of footwear may also include a routing element coupled to the sole structure, the strap at least partially disposed within the routing element. The panel may include an aperture, the strap slidably disposed within the aperture.

In some configurations, the upper includes a first aperture, the strap slidably disposed within the first aperture. Here, the upper may include a second aperture, the strap slidably disposed within the second aperture. Optionally, the upper may include a third aperture, the strap slidably disposed within the third aperture. The first aperture and the second aperture may be disposed on a medial side of the upper, and the third aperture may be disposed on a lateral side of the upper.

In some implementations, the first end is removably coupled to the second end. The first end may include a first fastener and the second end may include a second fastener configured to selectively engage the first fastener. The upper may include an outer surface and the panel may include an inner surface configured to engage the outer surface in the closed position. Optionally, the upper may include a lateral side and a medial side opposite the lateral side, the lateral side defining a lateral side of the throat, the medial side defining a medial side of the throat, the panel rotatably coupled to the lateral side or the medial side of the upper.

Another aspect of the disclosure provides an article of footwear. The article of footwear includes an upper defining a foot-receiving opening and a sole structure supported by the upper. The article of footwear also includes a panel coupled to the upper for rotation between an open position and a closed position. The panel is configured to cover at least a portion of the foot-receiving opening in the closed position. The article of footwear also includes a strap extending around the upper and including a first end and a second end. The first end includes a first engagement mechanism and the second end includes a second engagement mechanism configured to selectively couple the first end to the second end.

This aspect may include one or more of the following optional features. In some examples, the strap includes a first portion and a second portion extending from the first portion, the first portion extending from the first end, the second portion extending from the second end and overlapping the first portion of the strap at an intersection. Here, the intersection may be disposed on the panel. The upper may include a lateral side and a medial side, the first portion of the strap and the second portion of the strap at least partially disposed along the lateral side and the medial side. At least a portion of the first portion of the strap may be disposed between the sole structure and the upper. At least a portion of the second portion of the strap may be disposed between the sole structure and the upper.

In some configurations, the sole structure defines a channel extending therethrough, the strap at least partially disposed within the channel. The article of footwear may include a routing element coupled to the sole structure, the strap at least partially disposed within the routing element. The panel may include an aperture, the strap slidably disposed within the aperture.

In some implementations, the upper includes a first aperture, the strap slidably disposed within the first aperture. Here, the upper may include a second aperture, the strap slidably disposed within the second aperture. Optionally, the upper may include a third aperture, the strap slidably disposed within the third aperture. The first aperture and the second aperture may be disposed on a medial side of the upper, and the third aperture may be disposed on a lateral side of the upper.

In some examples, the upper includes an outer surface and the panel includes an inner surface configured to engage the outer surface in the closed position. Optionally, the upper may include a lateral side and a medial side opposite the lateral side, the lateral side defining a lateral side of the foot-receiving opening, the medial side defining a medial side of the foot-receiving opening, the panel rotatably coupled to the lateral side or the medial side of the upper.

The details of one or more implementations of the disclosure are set forth in the accompanying drawings and the description below. Other aspects, features, and advantages will be apparent from the description and drawings, and from the claims.

Referring to FIGS. 1A-4A, an example of an article of footwear 10 including a strap system 300 providing for tensioning relative to a wearer's foot is disclosed. In some implementations, the article of footwear 10 includes an upper 100 and a sole structure 200 attached to the upper 100. The strap system 300 may include a strap 302 and one or more routing elements 304 (FIG. 4) to manage the tension of the upper 100. As will be explained in more detail below, in some implementations, the upper 100 and the sole structure 200 cooperate to provide passages and guides for routing portions of the strap 302 through the article of footwear 10. The upper 100 and the strap system 300 cooperate to move the article of footwear 10 between a loosened state (e.g., FIGS. 1A and 2A) and a tightened state (e.g., FIGS. 1B and 2B). Particularly, the strap 302 is movable in a tightening direction DT (FIGS. 1A and 1B) to move the article of footwear 10 into the tightened state.

The article of footwear 10, and components thereof, may be described as including an anterior end 12 associated with a forward-most point of the footwear 10, and a posterior end 14 corresponding to a rearward-most point of the footwear 10. As shown in the bottom view of FIG. 3, a longitudinal axis $A_{10}$ of the footwear 10 extends along a length of the footwear 10 from the anterior end 12 to the posterior end 14, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14.

The article of footwear 10 may be divided into one or more regions along the longitudinal axis $A_{10}$. The regions may include a forefoot region 20, a mid-foot region 22, and a heel region 24. The forefoot region 20 may correspond with toes and joints connecting metatarsal bones with phalanx bones of a foot. The mid-foot region 22 may correspond with an arch area of the foot, and the heel region 24 may correspond with rear regions of the foot, including a calcaneus bone.

The upper 100 forms an enclosure having a plurality of components that cooperate to define an interior void 102 and an ankle opening 104, which cooperate to receive and secure a foot for support on the sole structure 200. For example, the upper 100 includes a pair of quarter panels 106 in the mid-foot region 22 on opposite sides of the interior void 102. A throat 108 extends across the top of the upper 100 and defines an instep region extending between the quarter panels 106 from the ankle opening 104 to the forefoot region 20. In the illustrated example, the throat 108 is enclosed with a panel 110 extending between the opposing quarter panels 106 in the instep region to cover the interior void 102. The panel 110 covering the throat 108 may be coupled to one of the quarter panels 106 and/or the forefoot region 20. For example, as illustrated in FIGS. 1B and 2B, in some implementations the panel 110 is hingedly coupled to the quarter panel 106 disposed on the medial side 18 of the footwear 10 for movement between an open state (e.g., FIGS. 1A and 2A) and a closed state (e.g., FIGS. 1B and 2B), where a portion of the panel 110 may overlap a portion of the quarter panel(s) 106 and/or the anterior end 12 of the footwear 10. In this regard, the panel 110 may include an inner surface 111 that engages an outer surface 114 of the upper 100 in the closed state.

The upper 100 of the article of footwear 10 may be further described as including heel side panels 110 extending from respective quarter panels 106 through the heel region 24 along the lateral and medial sides 16, 18 of the ankle opening 104. A heel counter 112 wraps around the posterior end 14 of the footwear 10 and connects the heel side panels 110. Uppermost edges of the throat 108, the heel side panels 110, and the heel counter 112 cooperate to form a collar 115, which defines the ankle opening 104 of the interior void 102.

The upper 100 may be formed from one or more materials that are stitched or adhesively bonded together to define the interior void 102. Suitable materials of the upper 100 may include, but are not limited to, textiles, foam, leather, and synthetic leather. The example upper 100 may be formed from a combination of one or more substantially inelastic or non-stretchable materials and one or more substantially elastic or stretchable materials disposed in different regions of the upper 100 to facilitate movement of the article of footwear 10 between the open state (e.g., FIGS. 1B and 2B) and the closed state (e.g., FIGS. 1A and 2A). The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity.

Figure 3:
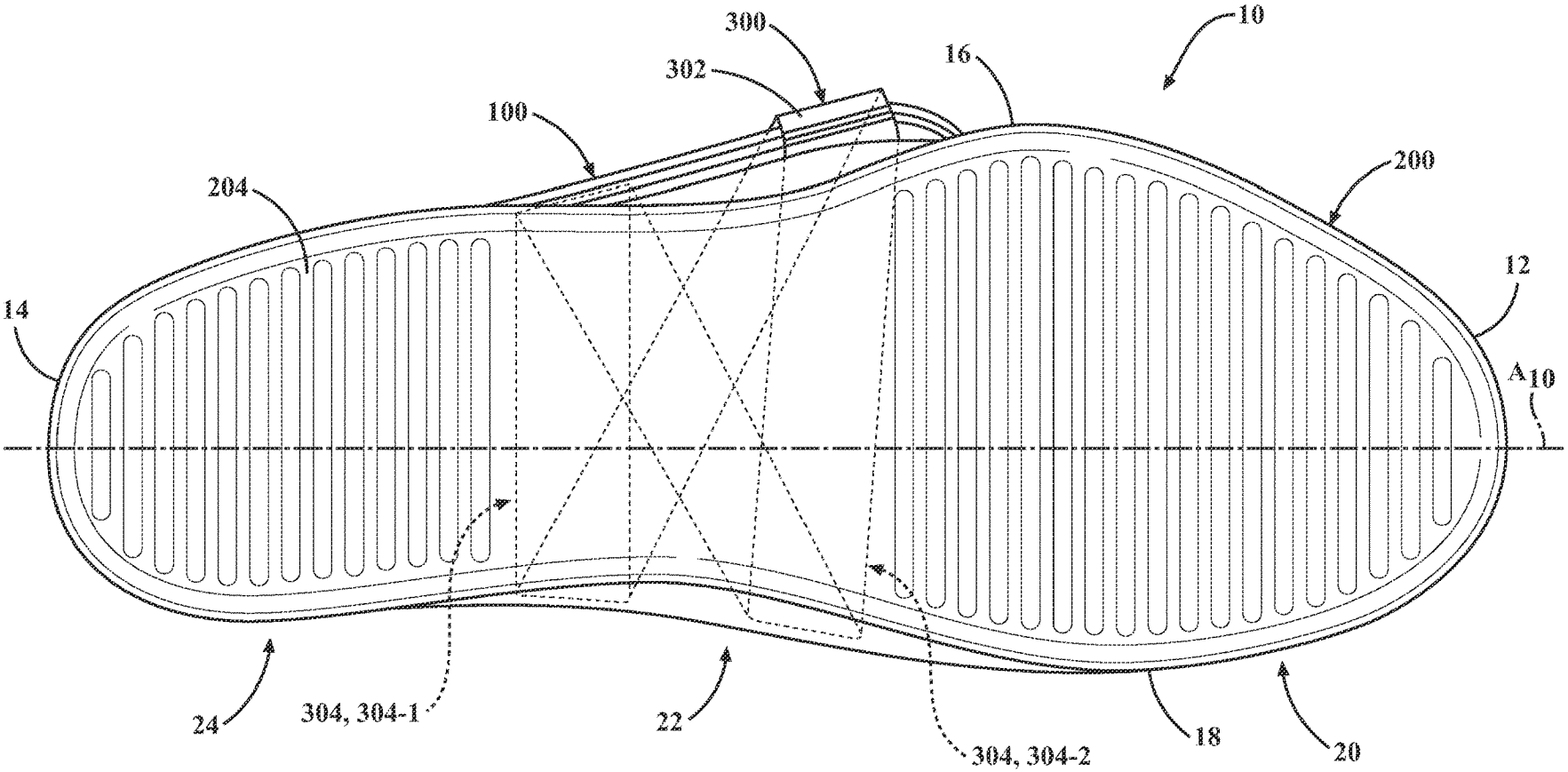
FIG. 3 is a bottom plan view of the article of footwear of FIG. 1A.
Figure 4A:
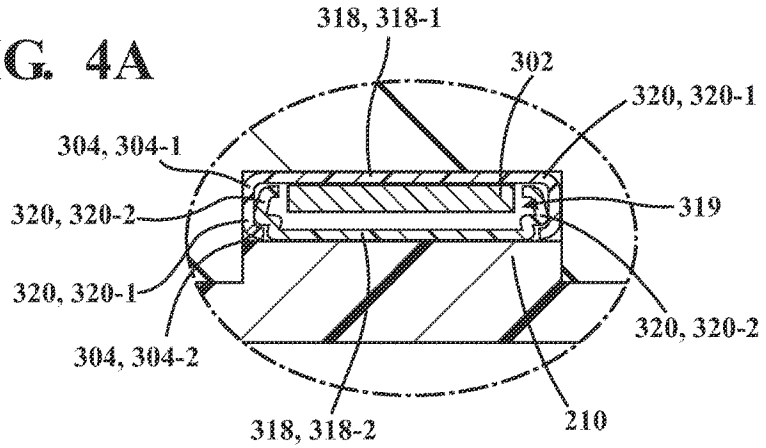
FIG. 4A is an enlarged view of portion 4A of the sole structure of FIG. 4.
Figure 4:
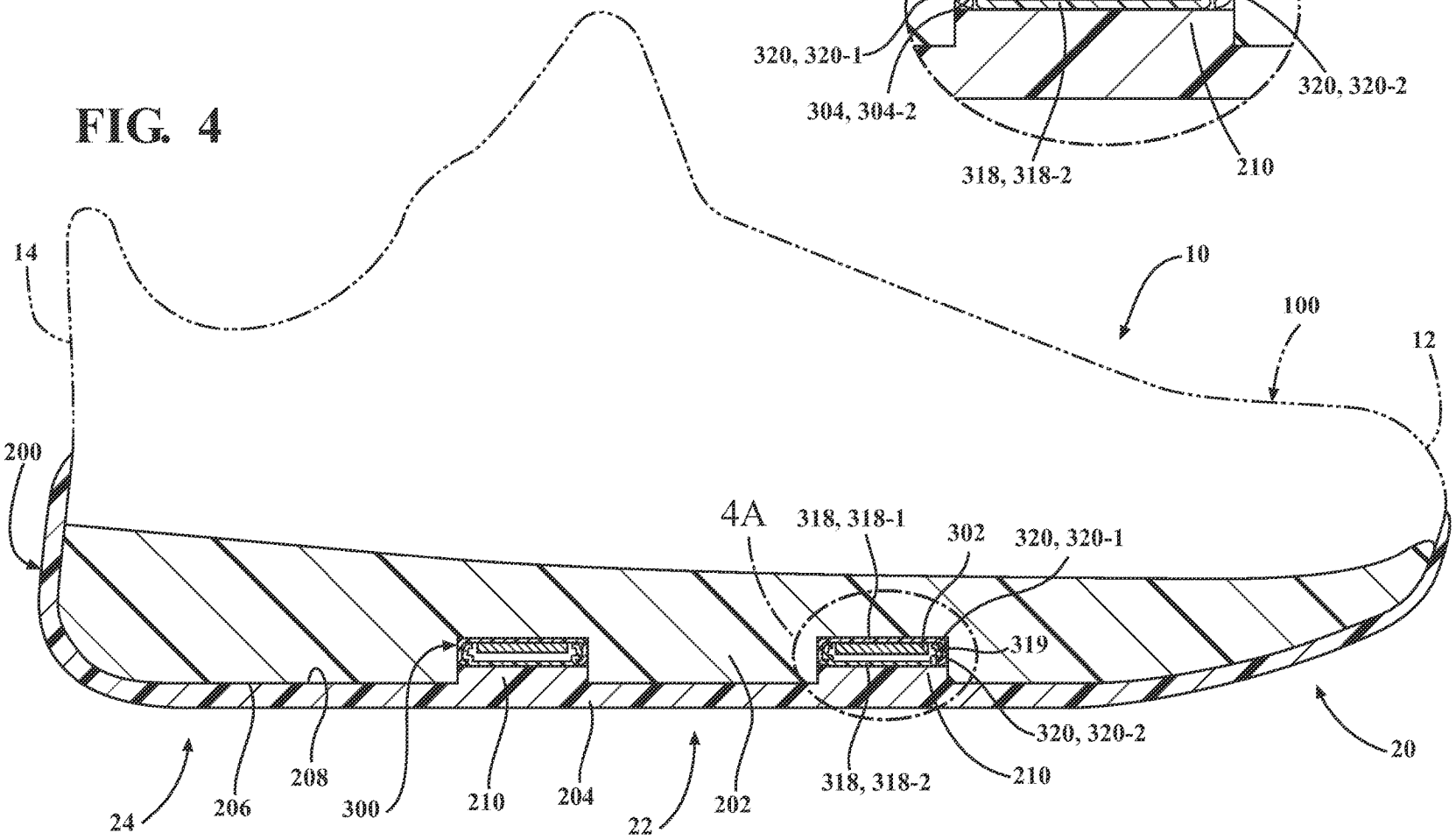
FIG. 4 is a longitudinal cross-sectional view of a sole structure of the article of footwear of FIG. 1A.
Figure 5:
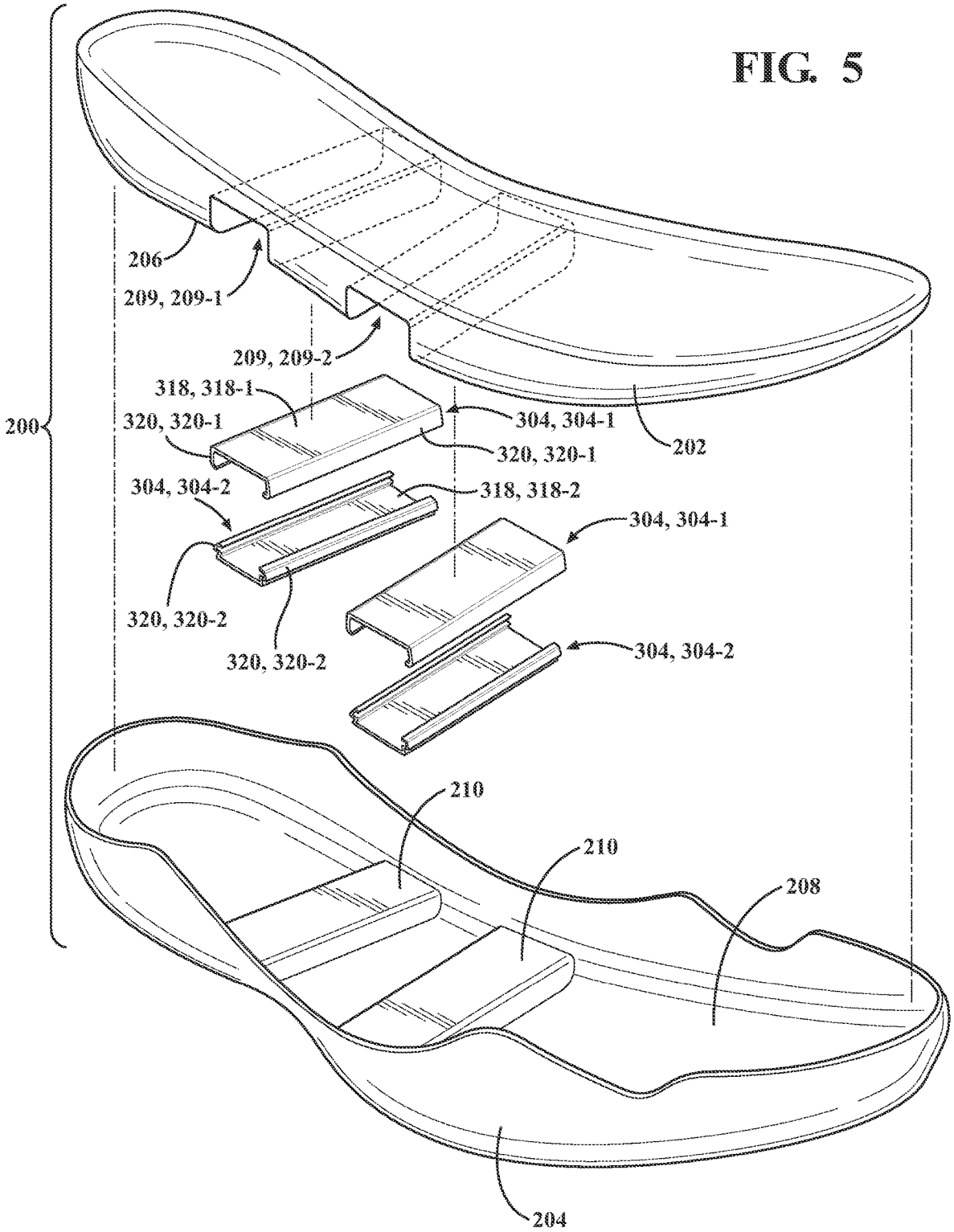
FIG. 5 is an exploded perspective view of the sole structure of FIG. 4.

With reference to FIGS. 3-5, the sole structure 200 is attached to the upper 100 and includes a midsole 202 configured to provide cushioning characteristics to the sole structure 200, and an outsole 204 configured to provide a ground-engaging surface 26 of the article of footwear 10. In this regard, as illustrated in FIGS. 4 and 5, the midsole 202 may include a lower surface 206 that engages an upper surface 208 of the outsole 204 in the assembled configuration. As previously described, the sole structure 200 may further receive a portion of the strap system 300 in the assembled configuration. In particular, as illustrated in FIG. 5, the lower surface 206 of the midsole 202 may include one or more channels 209 extending therethrough from the lateral side 16 to the medial side 18, while the upper surface 208 of the outsole 204 may include one or more protrusions 210 extending from the lateral side 16 to the medial side 18. As will be explained in more detail below, the channels 209 may receive the protrusions 210 and route portions of the strap system 300 (e.g., the strap 302 and/or the routing element(s) 304) through the article of footwear 10 in the assembled configuration. In some examples, a portion of the strap 302 may be encapsulated between the midsole 202 and the outsole 204 within the routing element(s) 304 and the channels 209.

Figure 1B:
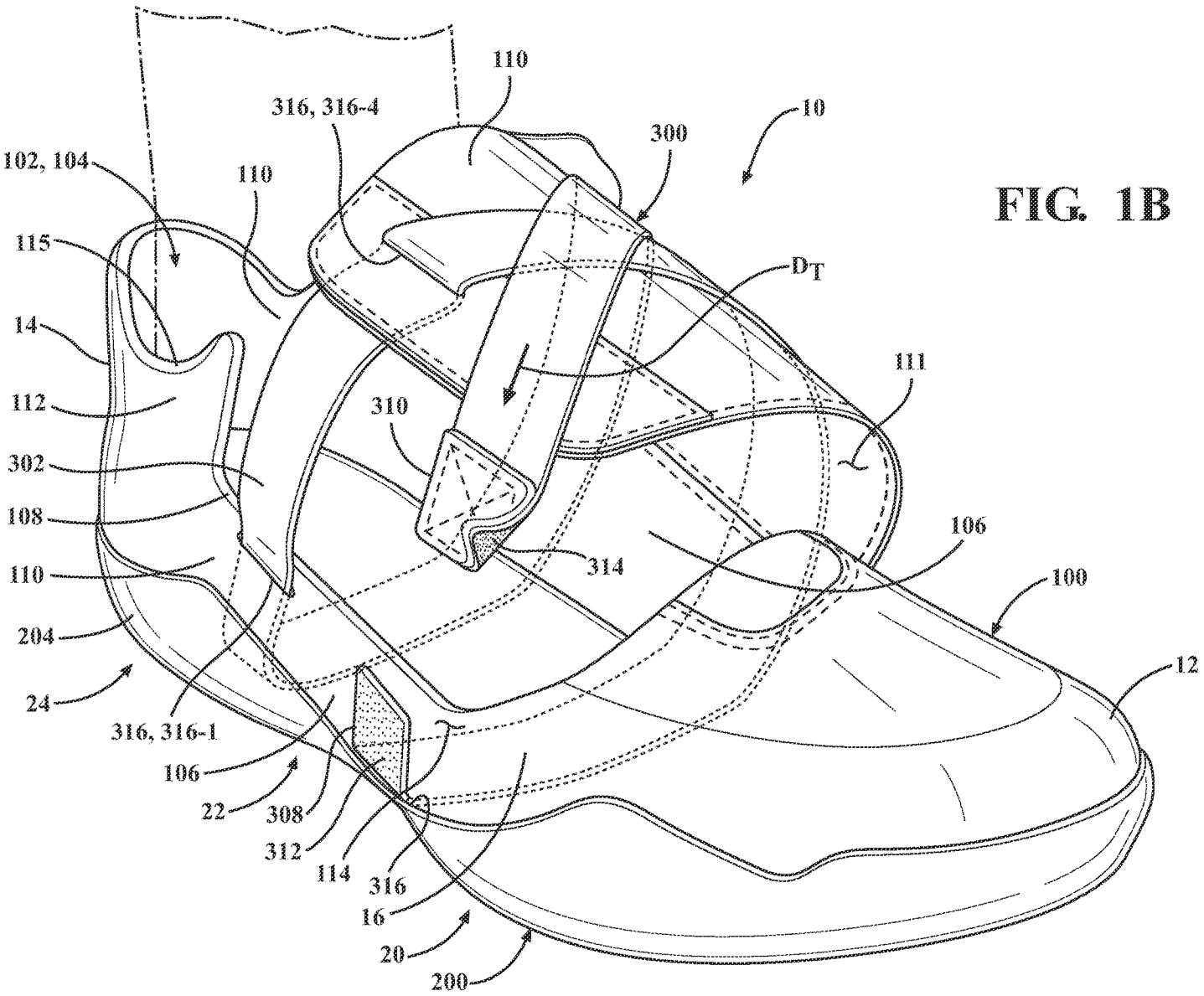
FIG. 1B is a lateral-side perspective view of the article of footwear of FIG. 1A, where the strap system is shown in a loosened state.
Figure 2A:
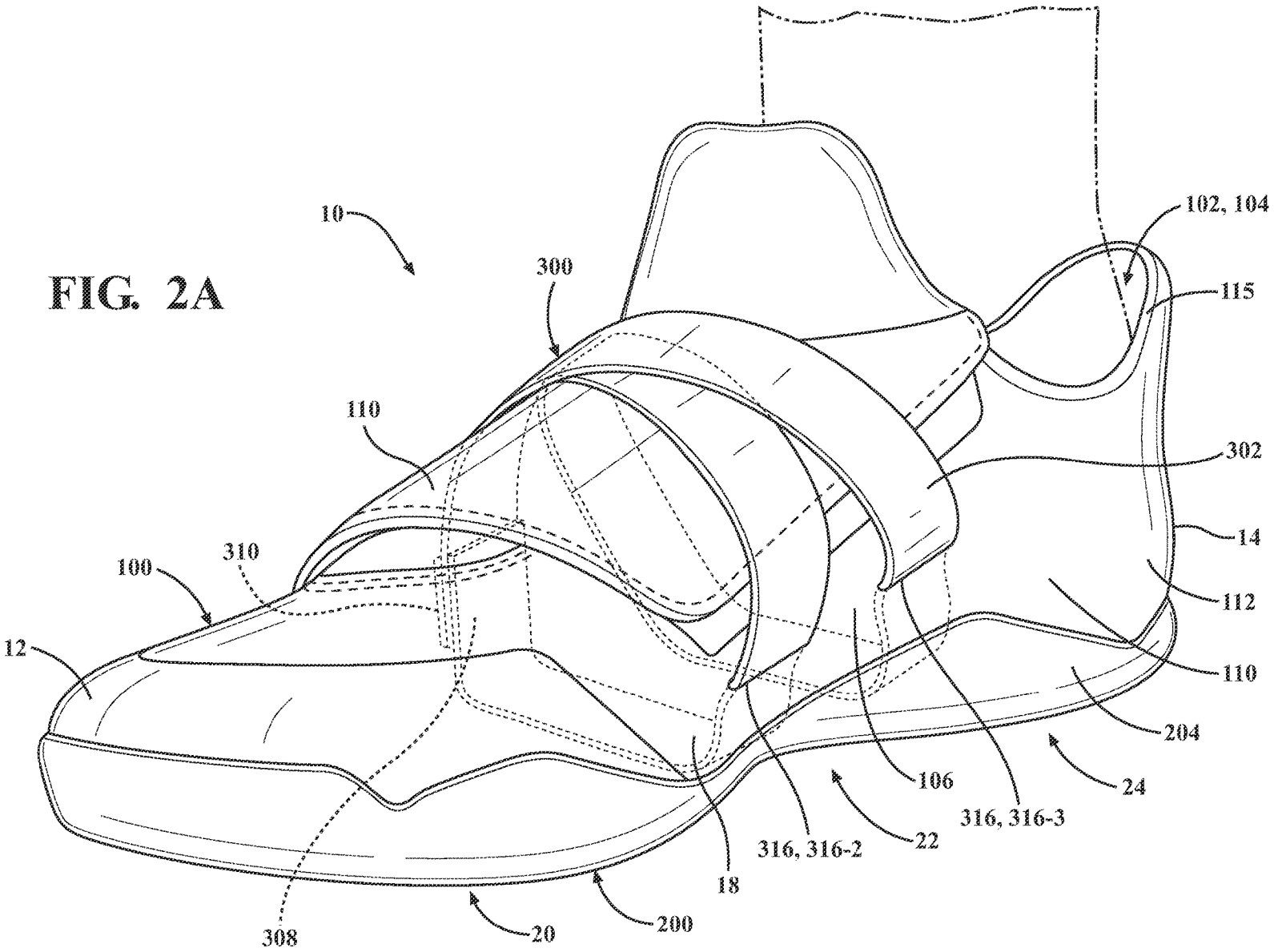
FIG. 2A is a medial-side perspective view of the article of footwear of FIG. 1A, where the strap system is shown in a tightened state.
Figure 2B:
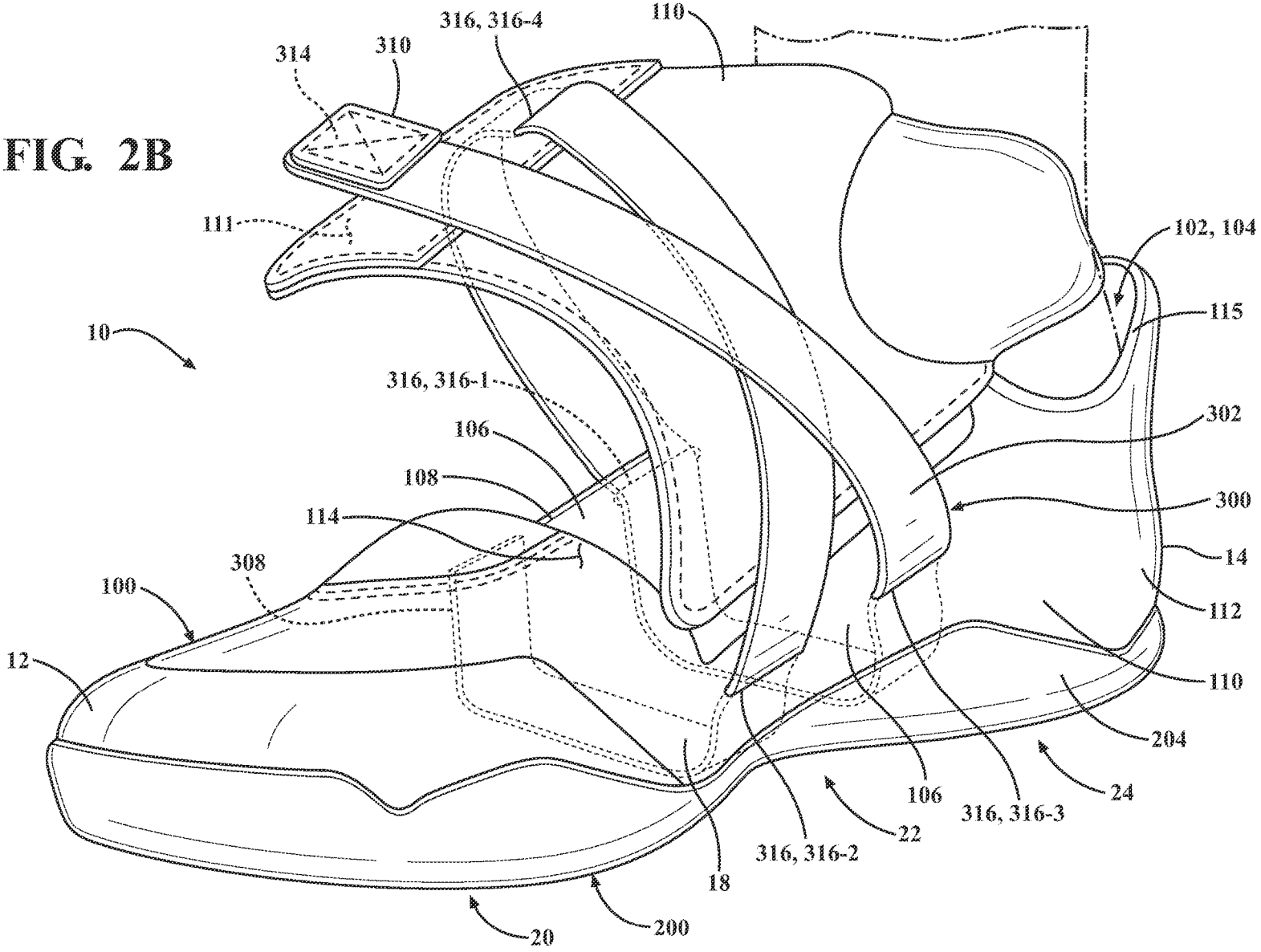
FIG. 2B is a medial-side perspective view of the article of footwear of FIG. 1A, where the strap system is shown in a loosened state.

As introduced above, the strap system 300 may be attached to the upper 100 and/or the sole structure 200 for moving the upper 100 between the open state (FIGS. 1B and 2B) and the closed state (FIGS. 1A and 2A). In this regard, the strap 302 may include a proximal end 308 and a distal end 310 opposite the proximal end 308. The proximal end 308 may be coupled to one or both of the upper 100 or the sole structure 200 and may include a first fastener 312. For example, the proximal end 308 may be fixed to the lateral quarter panel 106, proximate the anterior end 12 of the footwear 10, by stitching, adhesive, ultrasonic welding, or any other suitable technique. The first fastener 312 may include a loop, clip, hook-and-loop fastener, or any other suitable fastening system. In this regard, the distal end 310 may include a second fastener 314 that can be selectively coupled to the first fastener 312 in the closed state. For example, the second fastener 314 may include a hook-and-loop fastener configured to be selectively attached to the hook-and-loop fastener of the first fastener 312 in the closed state.

The strap 302 may be translatably routed through one or both of the upper 100 or the sole structure 200 in the assembled configuration. In this regard, one or more of the quarter panels 106 or the panel 110 may include one or more apertures 316 through which the strap 302 is translatably routed in the assembled configuration. In the illustrated example, the lateral quarter panel 106 includes a first aperture 316-1 proximate the throat 108, the medial quarter panel 106 includes second and third apertures 316-2, 316-3 proximate the throat 108, and the panel 110 includes a fourth aperture 316-4 proximate a lateral edge of the panel 110. As will be explained in more detail below, in the assembled configuration, the strap 302 may be routed through one or more of the apertures 316 such that the strap 302 can translate therethrough.

With reference to FIGS. 4-5, the routing element(s) 304 may include a first routing element 304-1 and a second routing element 304-2 and may be formed from a rigid or semi-rigid material (e.g., plastic, metal, carbon fiber, etc.). The first routing element 304-1 may include a base portion

318-1 and a pair of side portions 320-1 extending from opposing sides of the base portion 318-1. The second routing element 304-2 may likewise include a base portion 318-2 and a pair of side portions 320-2 extending from opposing sides of the base portion 318-2. In some implementations, the side portions 320-1 of the first routing element 304-1 define a substantially L-shaped construct, such that the first routing element 304-1 defines a substantially C-shaped construct. In the assembled configuration, the side portions 320-2 of the second routing element 304-2 may be disposed within and/or attached to the side portions 320-1 of the first routing element 304-1, such that the base portions 318-1, 318-2 and the side portions 320-1, 320-2 define a passage 319 extending therethrough. One or both of the first or second routing elements 304-1, 304-2 may be disposed within a first channel 209-1 of the channels 209, and one or both of the first or second routing elements 304-1, 304-2 may be disposed within a second channel 209-2 of the channels 209. For example, the routing elements 304-1, 304-2 may be disposed within the channels 209-1, 209-2 and extend from the lateral side 16 to the medial side 18 of the footwear. In some implementations, the base portion 318-1 and the side portions 320-1 engage the midsole 202, while the base portion 318-2 engages the outsole 204.

In the assembled configuration, the strap 302 may extend (i) from the proximal end 308 coupled to the lateral quarter panel 106 proximate the anterior end 12 of the footwear 10, (ii) through the upper 100 and/or the sole structure 200 (e.g., between the midsole 202 and the outsole 204), (iii) through the second channel 209-2 (e.g., through the routing elements 304-1, 304-2), (iv) through the upper 100 and/or the sole structure 200 (e.g., between the midsole 202 and the outsole 204), (v) through the second aperture 316-2 in the medial quarter panel 106, (vi) across the throat 108 (e.g., traversing (e.g., over, under, through, etc.) the panel 110), (vii) through the fourth aperture 316-4 in the panel 110, (viii) through the first aperture 316-1 in the lateral quarter panel 106, (ix) through the upper 100 and/or the sole structure 200 (e.g., between the midsole 202 and the outsole 204), (x) through the first channel 209-1 (e.g., through the routing elements 304-1, 304-2), (xi) through the upper 100 and/or the sole structure 200 (e.g., between the midsole 202 and the outsole 204), (xii) through the third aperture 316-3 in the medial quarter panel 106, (xiii) across the throat 108 (e.g., traversing (e.g., over, under, through, etc.) the panel 110), including across (e.g., over or under) the portion of the strap 302 traversing the panel at (vi) such that the strap forms an X-shaped intersection proximate the throat 108, and (xiv) to the distal end 310 selectively coupled to the proximal end 308 proximate the anterior end 12 of the footwear 10. In this way, the straps 302 may completely surround the upper 100 and a portion of the sole structure 200 twice in the mid-foot region 22 of the article of footwear 10.

With particular reference to FIGS. 6 and 7, another strap system **300*a* for use with an article of footwear (e.g., article of footwear 10) is shown. In view of the substantial similarity in structure and function of the components associated with the strap system 300*a* relative to the strap system 300**, like reference numerals are used hereinafter and in the drawings to identify like components while like reference numerals containing letter extensions are used to identify those components that have been modified.

The strap system **300*a* may include the strap 302 and one or more routing elements 304*a* to manage the tension of the upper 100. For example, the routing elements 304*a* may include a primary routing element 304*a*-1 and a pair of secondary routing elements 304*a*-2. The primary routing element 304*a*-1 may include a first attachment feature 322 disposed at a proximal end 324 of the primary routing element 304*a*-1, and a second attachment feature 326 disposed at a distal end 328 of the primary routing element 304*a*-1. The first and second attachment features 322, 326 may each include a pair of recesses 330, 332 formed in opposed upper and lower sides 334, 336 of the primary routing element 304*a*-1. In some implementations, the first and second attachment features 322, 326 each include a pair of ribs 338 extending from a first lateral side 340 of the primary routing element 304*a*-1 to a second lateral side 342 of the primary routing element 304*a*-1. In this regard, the first lateral side 340 may be opposite the second lateral side 342, and the upper side 334 may be opposite the lower side 336 such that the ribs 338 are disposed between the upper and lower sides 334, 336 and extend across one or both of the first or second recesses 330, 332. The primary routing element 304*a*-1 may further include a longitudinal passage 344 extending therethrough from, and through, the proximal end 324 to, and through, the distal end 328. In this regard, the passage 344 may be defined by and between the upper and lower sides 334, 336, the first and second lateral sides 340, 342, and the pair of ribs 338**.

The secondary routing elements **304*a*-2 may include an end portion 346 and a pair of legs 348 extending therefrom. The end portion 346 may include a front side 350, a rear side 352 opposite the front side 350, and an aperture 351 extending through the front and rear sides 350, 352. The legs 348 may extend from the rear side 352 on opposite sides of the aperture 351 and may each include a tooth 354 extending therefrom. In this regard, each tooth 354 may extend from one leg 348 of the pair of legs 348 toward the other leg 348 of the pair of legs 348**.

In an assembled configuration (FIG. 7), the secondary routing elements **304*a*-2 may be coupled to the proximal and distal ends 324, 328 of the primary routing element 304*a*-1. For example, the legs 348 may be disposed within the recesses 330, 332 such that (i) each rib 338 is disposed, and secured, between the tooth 354 and the end portion 346, and (ii) the aperture 351 of the secondary routing elements 304*a*-2 is aligned with the passage 344 of the primary routing element 304*a*-1**.

The routing elements **304*a*-1, 304*a*-2 may be coupled to the sole structure 200 such that the strap 302 can be routed therethrough in the manner previously described relative to the strap system 300. In this regard, the routing elements 304*a*-1, 304*a*-2 may be disposed within the channels 209-1, 209-2. Alternatively, the routing elements 304*a*-1, 304*a*-2 may be disposed at other locations within the sole structure 200, such as (i) between the midsole 202 and an insole 212, (ii) between the midsole 202 and the outsole 204, or (iii) encapsulated within the midsole 202, the outsole 204, or the insole 212, such that the strap 302 can be translatably routed through the passage 344 and the apertures 351**.

Referring to FIGS. 1A-2B, the articles of footwear 10, **10*a* can be moved from the open state to the closed state after being placed on a user's foot by applying a force (e.g., pulling) on the distal end 310 of the strap 302. Pulling on the distal end 310 may cause the strap 302 to translate within and through the routing elements 304, 304*a*-1, 304*a*-2 and the apertures 316-1, 316-2, 316-3, 316-4 in a first direction such that the upper 100 tightens around the user's foot. To secure the upper in the tightened state, the user can secure the distal end 310 (e.g., the second fastener 314) to the proximal end 308 (e.g., the first fastener 312**).

When the user desires to remove the article of footwear 10, **10*a* from the foot, the strap system 300, 300*a* can be moved to the open state to allow the upper 100 to be relaxed around the foot by removing the distal end 310 (e.g., the second fastener 314) from the proximal end 308 (e.g., the first fastener 312) and allowing the strap 302 to translate within and through the routing elements 304, 304*a*-1, 304*a*-2 and the apertures 316-1, 316-2, 316-3, 316-4 in a second direction such that the upper 100** loosens around the user's foot.

The following Clauses provide an exemplary configuration for an article of footwear described above.

Clause 1: An article of footwear comprising an upper defining a throat configured to receive a foot, a sole structure coupled to the upper, a panel having a first side coupled to the upper for movement between an open position and a closed position, the panel exposing a portion of the throat in the open position and covering the portion of the throat in the closed position, and a strap having a first end and a second end opposite the first end, the first end and the second end disposed on a first side of the upper with a body portion of the strap disposed between the first end and the second end surrounding the upper.

Clause 2: The article of footwear of Clause 1, wherein the body portion of the strap includes a first portion and a second portion extending from the first portion, the first portion extending from the first end, the second portion extending from the second end and overlapping the first portion of the strap at an intersection.

Clause 3: The article of footwear of Clause 2, wherein the intersection is disposed on the panel.

Clause 4: The article of footwear of Clause 2, wherein the upper includes a lateral side and a medial side, the first portion of the strap and the second portion of the strap at least partially disposed along the lateral side and the medial side.

Clause 5: The article of footwear of Clause 2, wherein at least a portion of the first portion of the strap is disposed between the sole structure and the upper.

Clause 6: The article of footwear of Clause 5, wherein at least a portion of the second portion of the strap is disposed between the sole structure and the upper.

Clause 7: The article of footwear of any of the preceding clauses, wherein the sole structure defines a channel extending therethrough, the strap at least partially disposed within the channel.

Clause 8: The article of footwear of any of the preceding clauses, further comprising a routing element coupled to the sole structure, the strap at least partially disposed within the routing element.

Clause 9: The article of footwear of any of the preceding clauses, wherein the panel includes an aperture, the strap slidably disposed within the aperture.

Clause 10: The article of footwear of any of the preceding clauses, wherein the upper includes a first aperture, the strap slidably disposed within the first aperture.

Clause 11: The article of footwear of Clause 10, wherein the upper includes a second aperture, the strap slidably disposed within the second aperture.

Clause 12: The article of footwear of Clause 11, wherein the upper includes a third aperture, the strap slidably disposed within the third aperture.

Clause 13: The article of footwear of Clause 12, wherein the first aperture and the second aperture are disposed on a medial side of the upper, and the third aperture is disposed on a lateral side of the upper.

Clause 14: The article of footwear of any of the preceding clauses, wherein the first end is removably coupled to the second end.

Clause 15: The article of footwear of any of the preceding clauses, wherein the first end includes a first fastener and the second end includes a second fastener configured to selectively engage the first fastener.

Clause 16: The article of footwear of any of the preceding clauses, wherein the upper includes an outer surface and the panel includes an inner surface configured to engage the outer surface in the closed position.

Clause 17: The article of footwear of any of the preceding clauses, wherein the upper includes a lateral side and a medial side opposite the lateral side, the lateral side defining a lateral side of the throat, the medial side defining a medial side of the throat, the panel rotatably coupled to the lateral side or the medial side of the upper.

Clause 18: An article of footwear comprising an upper defining a foot-receiving opening, a sole structure supported by the upper, a panel coupled to the upper for rotation between an open position and a closed position, the panel configured to cover at least a portion of the foot-receiving opening in the closed position, and a strap extending around the upper and including a first end and a second end, the first end including a first engagement mechanism and the second end including a second engagement mechanism configured to selectively couple the first end to the second end.

Clause 19: The article of footwear of Clause 18, wherein the strap includes a first portion and a second portion extending from the first portion, the first portion extending from the first end, the second portion extending from the second end and overlapping the first portion of the strap at an intersection.

Clause 20: The article of footwear of Clause 19, wherein the intersection is disposed on the panel.

Clause 21: The article of footwear of Clause 19, wherein the upper includes a lateral side and a medial side, the first portion of the strap and the second portion of the strap at least partially disposed along the lateral side and the medial side.

Clause 22: The article of footwear of Clause 21, wherein at least a portion of the first portion of the strap is disposed between the sole structure and the upper.

Clause 23: The article of footwear of Clause 22, wherein at least a portion of the second portion of the strap is disposed between the sole structure and the upper.

Clause 24: The article of footwear of any of the preceding clauses, wherein the sole structure defines a channel extending therethrough, the strap at least partially disposed within the channel.

Clause 25: The article of footwear of any of the preceding clauses, further comprising a routing element coupled to the sole structure, the strap at least partially disposed within the routing element.

Clause 26: The article of footwear of any of the preceding clauses, wherein the panel includes an aperture, the strap slidably disposed within the aperture.

Clause 27: The article of footwear of any of the preceding clauses, wherein the upper includes a first aperture, the strap slidably disposed within the first aperture.

Clause 28: The article of footwear of Clause 27, wherein the upper includes a second aperture, the strap slidably disposed within the second aperture.

Clause 29: The article of footwear of Clause 28, wherein the upper includes a third aperture, the strap slidably disposed within the third aperture.

Clause 30: The article of footwear of Clause 29, wherein the first aperture and the second aperture are disposed on a medial side of the upper, and the third aperture is disposed on a lateral side of the upper.

Clause 31: The article of footwear of any of the preceding clauses, wherein the upper includes an outer surface and the panel includes an inner surface configured to engage the outer surface in the closed position.

Clause 32: The article of footwear of any of the preceding clauses, wherein the upper includes a lateral side and a medial side opposite the lateral side, the lateral side defining a lateral side of the foot-receiving opening, the medial side defining a medial side of the foot-receiving opening, the panel rotatably coupled to the lateral side or the medial side of the upper.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. An article of footwear comprising:

an upper defining a throat and an ankle opening configured to receive a foot, the throat extending from the ankle opening to a forefoot region and from a lateral side to a medial side of the article of footwear, the throat defining an opening disposed between the lateral side and the medial side;

a sole structure coupled to the upper; and a panel coupled to the upper on the lateral side, the panel being movable between an open position and a closed position, wherein when the panel is in the open position, a substantial entirety of the throat is unobstructed, and when the panel is in the closed position, the panel is the only material obstructing a top of the throat along a lateral-medial center of the throat, and wherein the panel includes an aperture proximate an edge of the panel and through which a strap is translatably routed, and the strap, having a first end and a second end opposite the first end, wherein the first end and the second end are disposed on a first side of the upper, wherein the strap includes a body portion between the first end and the second end surrounding the upper and within an aperture of the panel.

2. The article of footwear of claim 1, wherein the body portion of the strap includes a first portion and a second portion extending from the first portion, the first portion extending from the first end, the second portion extending from the second end and overlapping the first portion of the strap at an intersection, wherein the intersection is disposed on the panel, wherein the upper includes a lateral side and a medial side, the first portion of the strap and the second portion of the strap at least partially disposed along the lateral side and the medial side, wherein at least a portion of the first portion of the strap is disposed between the sole structure and the upper, and wherein at least a portion of the second portion of the strap is disposed between the sole structure and the upper.

3. The article of footwear of claim 1, wherein the sole structure defines a channel extending therethrough, the strap at least partially disposed within the channel.

4. The article of footwear of claim 1, wherein the first end includes a first fastener and the second end includes a second fastener configured to selectively engage the first fastener.

5. The article of footwear of claim 1, wherein the upper includes an outer surface and the panel includes an inner surface configured to engage the outer surface in the closed position.

6. The article of footwear of claim 1, wherein in the closed position, an entirety of the throat is obstructed by the panel.

7. An article of footwear comprising:

an upper defining a foot-receiving opening, wherein a throat of the foot-receiving opening extends from a lateral side of the upper to a medial side of the upper;

a sole structure supported by the upper; and a panel coupled to the upper on the medial side at an interface, the panel being configured to rotate between an open position and a closed position, the panel configured to expose an entirety of the throat of the foot-receiving opening in the open position, wherein the throat extends from the interface on the medial side to the lateral side and the panel is the only material obstructing a top of the throat at the interface in the closed position, and wherein the panel includes an aperture through which a strap having a first end and a second end opposite the first end is translatably routed, such that the first end and the second end are disposed on a first side of the upper.

8. The article of footwear of claim 7, further comprising:

the strap, extending around the upper, the first end including a first engagement mechanism and the second end including a second engagement mechanism configured to selectively couple the first end to the second end, the strap slidably disposed within the aperture in the panel, wherein the strap includes a first portion and a second portion extending from the first portion, the first portion extending from the first end, the second portion extending from the second end and overlapping the first portion of the strap at an intersection, wherein the intersection is disposed on the panel, wherein the upper includes a lateral side opposite the medial side, the first portion of the strap and the second portion of the strap at least partially disposed along the lateral side and the medial side, wherein at least a portion of the first portion of the strap is disposed between the sole structure and the upper, and wherein at least a portion of the second portion of the strap is disposed between the sole structure and the upper.

9. The article of footwear of claim 8, wherein the sole structure defines a channel extending therethrough, the strap at least partially disposed within the channel.

10. The article of footwear of claim 8, further comprising:

a routing element coupled to the sole structure, the strap at least partially disposed within the routing element, wherein the upper includes at least one aperture, the strap slidably disposed within the at least one aperture.

11. The article of footwear of claim 7, further comprising:

a pair of side panels including a medial side panel and a lateral side panel, the pair of side panels including a second aperture on the lateral side panel, a third aperture on the medial side panel, and a fourth aperture on the medial side panel, and wherein the strap is routed from the first end, through the sole structure, through the third aperture and extending over the panel, through the aperture of the panel, through the second aperture, through the sole structure, through the fourth aperture and extending over the panel to the second end.

12. The article of footwear of claim 11, wherein the first end includes a first engagement mechanism and the second end includes a second engagement mechanism, the first engagement mechanism and the second engagement mechanism configured to selectively couple the first end to the second end, and wherein the strap is slidably disposed within the aperture in the panel.

13. The article of footwear of claim 11, wherein the panel is hingedly and directly coupled to only the medial side panel of the pair of side panels when in the open position, the panel covering a portion of the pair of side panels when in the closed position.

14. An article of footwear comprising:

an upper defining a foot-receiving opening, wherein a throat of the foot-receiving opening extends from a lateral side of the upper to a medial side of the upper;

a sole structure supported by the upper, the sole structure including one or more channels; and a panel coupled to the medial side, the panel being movable between an open position and a closed position, wherein when the panel is in the open position, an entirety of the throat is unobstructed, and when the panel is in the closed position, an entirety of the throat is obstructed only by the panel, wherein the panel includes an aperture through which a strap is translatably routed to surround the upper, and the strap, having a first end and a second end opposite the first end, wherein the first end and the second end are disposed on a first side of the upper, wherein the strap includes a body portion between the first end and the second end surrounding the upper and within the aperture of the panel.

15. The article of footwear of claim 14, further comprising:

the strap, routed through the sole structure, wherein the strap is configured to move the article of footwear between a loosened state and a tightened state, and wherein the first end includes a first fastener, and the second end includes a second fastener.

16. The article of footwear of claim 15, wherein one or more routing elements extending between a medial side and a lateral side of the article of footwear are disposed in one or more channels of the article of footwear, the one or more routing elements configured to route a portion of the strap there through.

17. The article of footwear of claim 16, wherein the panel includes an interface and the throat extends from the interface on the medial side to the lateral side, and wherein along a lateral-medial center of the throat and at the interface, the panel is the only material obstructing a top of the throat at the interface.

18. The article of footwear of claim 15, wherein the first end is coupled to one of the upper or the sole structure.

19. The article of footwear of claim 14, wherein the panel is hingedly and directly coupled to only the medial side of the upper when in the open position, the panel covering a portion of the medial side and/or the lateral side when in the closed position.

* * * * *